US005906057A

United States Patent [19]

Borsoi

[11] Patent Number: 5,906,057

[45] Date of Patent: May 25, 1999

[54] SPORTS BOOT INCLUDING FLEXIBLE AND TRACTION RESISTANT RETURN ELEMENTS

[75] Inventor: Bruno Borsoi, Victorio Veneto, Italy

[73] Assignee: Salomon S.A., Metz-Tessy, France

[21] Appl. No.: 08/919,114

[22] Filed: Aug. 28, 1997

[30] Foreign Application Priority Data

Aug. 29, 1996 [FR] France ..... 96.10700

[51] Int. Cl.[6] ..... A43C 11/00; A43C 1/04

[52] U.S. Cl. ..... 36/50.1; 24/714.7

[58] Field of Search ..... 36/50.1, 50.5; 24/713.5, 714.7, 714.6, 715, 715.1, 715.2

[56] References Cited

U.S. PATENT DOCUMENTS

| | | | |
|---|---|---|---|
| 795,119 | 7/1905 | Harlow | 24/714.6 |
| 1,242,774 | 10/1917 | Curry | 24/714.6 |
| 1,246,724 | 11/1917 | Daggett | 24/715.1 |
| 1,282,539 | 10/1918 | Carlson | 24/715.1 |
| 1,292,975 | 1/1919 | Valade | 24/714.7 |
| 1,429,657 | 9/1922 | Trawinski | 24/714.7 |
| 3,239,903 | 3/1966 | Steinberg | 24/146 |
| 4,633,548 | 1/1987 | Siskind et al. | 36/50.1 |
| 5,761,777 | 6/1998 | Leick | 24/714.6 |

FOREIGN PATENT DOCUMENTS

| | | |
|---|---|---|
| 0717942 | 6/1996 | European Pat. Off. . |
| 1349832 | 4/1964 | France . |
| 1404799 | 11/1965 | France . |
| 2726440 | 5/1996 | France . |

*Primary Examiner*—M. D. Patterson
*Attorney, Agent, or Firm*—Greenblum & Bernstein P.L.C.

[57] ABSTRACT

A sports boot that includes a tightening device cooperating with a series of return elements for tightening an upper portion, each return portion including a closed loop made of a flexible and traction-resistant material, wherein the return element includes a guiding portion connected to the loop and has a sliding surface for the passage of the tightening device within the loop along a passage plane P, the guiding element having enough stiffness in the plane P to resist deformation when the tightening device is placed under tension. The tightening efficiency is thus optimized by reducing friction. The size of the return element is limited in order to provide greater comfort in case pressure is exerted by an external element.

20 Claims, 3 Drawing Sheets

SPORTS BOOT INCLUDING FLEXIBLE AND TRACTION RESISTANT RETURN ELEMENTS

BACKGROUND OF THE INVENTION

1. Field of the Invention

The present invention is related to the field of sports boots, especially to technical boots of the types such as those used in hiking, snowboarding, in-line skating and hang gliding.

2. Description of Background and Relevant Information

Sports boots of the types cited above are traditionally made up of a sole and an upper equipped with an opening for the passage of the foot, and they include, on either side of such opening, return elements or guides that cooperate with one or several tightening devices, such as a lace, so as to ensure the partial closure of the opening via tightening.

In the case of some boots, the return elements that are localized on top of one portion of the upper, are subject to pressure under various circumstances. Some snowboarding boots, for instance, are adapted to cooperate with a binding that includes transverse straps that exert pressure at the top of the foot, and consequently, also compress the return elements or guides. It has been noted that large or rigid guides such as hooks, loops or metallic or plastic eyelets can cause the creation of hard spots. This, in turn, can cause pain to the foot and also cause the strap to become deformed at certain areas in a more or less permanent manner.

Some hiking boots or other boots, that have an inner tightening device for a portion of the upper also encounter similar problems. In this case, the inner portion of the upper comprises return elements that are subject to pressure from an external portion of the upper after the latter has been tightened via various means (lacing, velcro, zipper closures, etc.). Once again, these pressures can cause discomfort or cause deformation of the boot, both of which are better avoided.

In order to overcome this problem, flexible and traction resistant guides elements have been known to be used, in the form of textile strips shaped like a loop and connected to the upper in order to limit their volume and encourage their deformation under the effect of an external pressure.

An example of such usage is provided in the document FR-A-2,726,440 that is related to a sports boot that includes an inner tightening device in the area of the instep and wherein an external protective upper is provided against external attacks that tighten the inner device and therefore exert pressure on the return elements of the device.

However, these return elements do not provide total satisfaction.

Due to the nature and characteristics of the loop, especially its texture and flexibility, the tightening efficiency is not optimal. The friction borne by the lace is high. In addition, the lace deforms the strips by shrinking its width due to the return angle; this causes additional friction and can cause premature wear and tear of the loop, and can even cause it to break.

SUMMARY OF THE INVENTION

It is an object of the present invention to provide a satisfactory solution to the disadvantages cited hereinabove.

This object is accomplished by using a return element that includes a guiding portion which is connected to a loop and has a sliding surface for the passage of the tightening device within the loop along a passage plane P; the guiding portion is stiff enough along plane P to resist deformation when the tightening device is placed under tension.

Such a return element has the advantages of limited volume and substantial flexibility, whilst at the same time it reduces friction with the lace. The lace then functions efficiently and lasts much longer.

BRIEF DESCRIPTION OF THE DRAWINGS

Other characteristics and advantages of the invention will become apparent from the characteristics of the detailed description that follows and that is illustrated by the annexed drawings wherein.

DETAILED DESCRIPTION OF THE PREFERRED EMBODIMENTS

Figure 1:
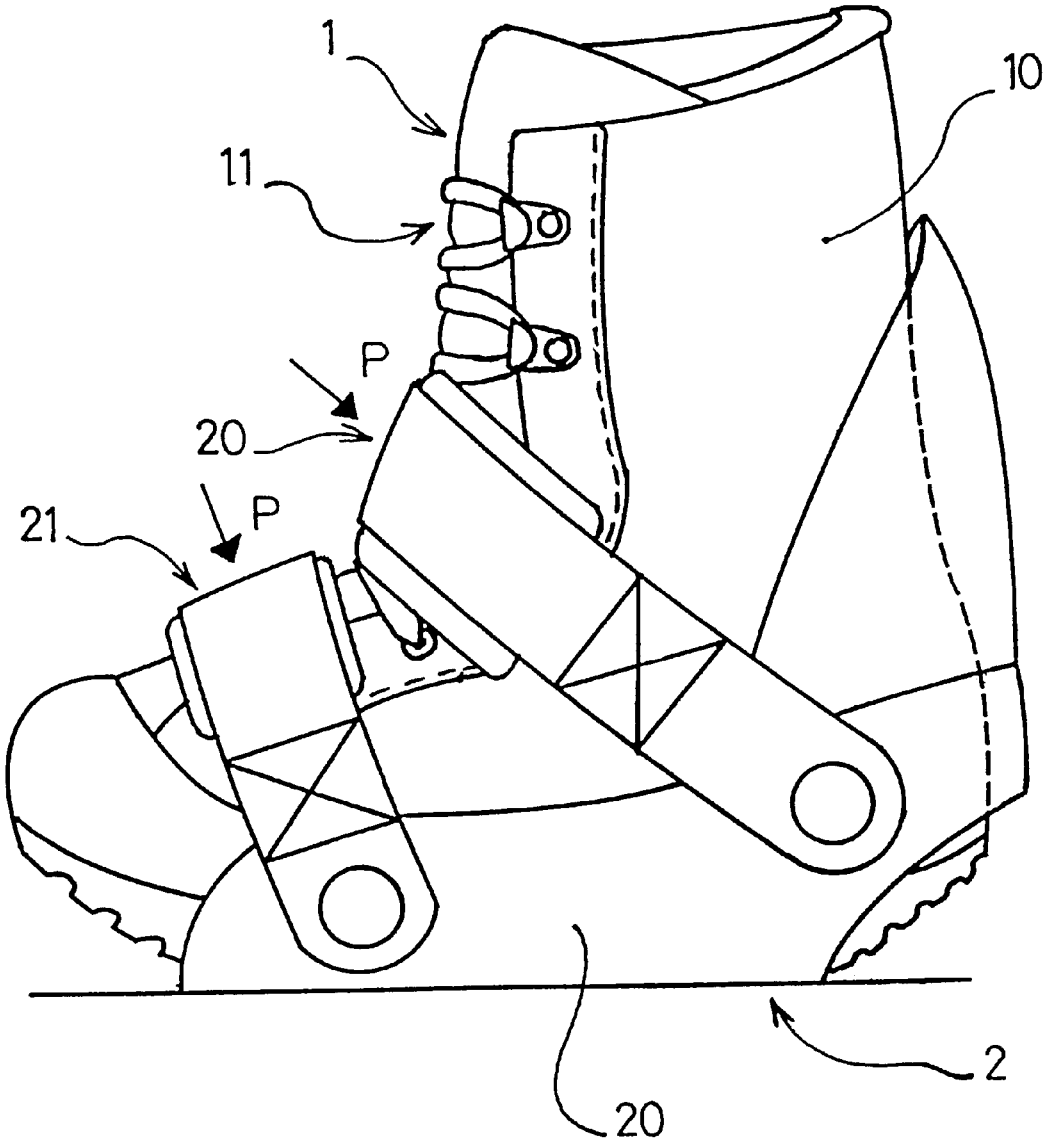
FIG. 1 is a schematic representation of a snowboarding boot that is held in a strap binding.

With reference to FIG. 1, a practical example of a boot according to the invention is shown, which enables one of the above-cited technical problems to be highlighted.

Boot 1 is a snowboarding boot that includes a flexible or semi-flexible upper 10 and a tightening device 11 for such upper. In the configuration as represented, the boot is in position in a traditional snowboard binding 2, which has the special characteristic of comprising a base 22 adapted to be attached to a board (not represented) and two straps 22, 21 that firmly maintain the boot in the base 20.

The straps 20, 21 thus exert a strong localized pressure on the tightening device. This is why it is necessary to provide suitable return elements so that the risks of discomfort and the other problems cited hereinbefore can be avoided.

Figure 2:
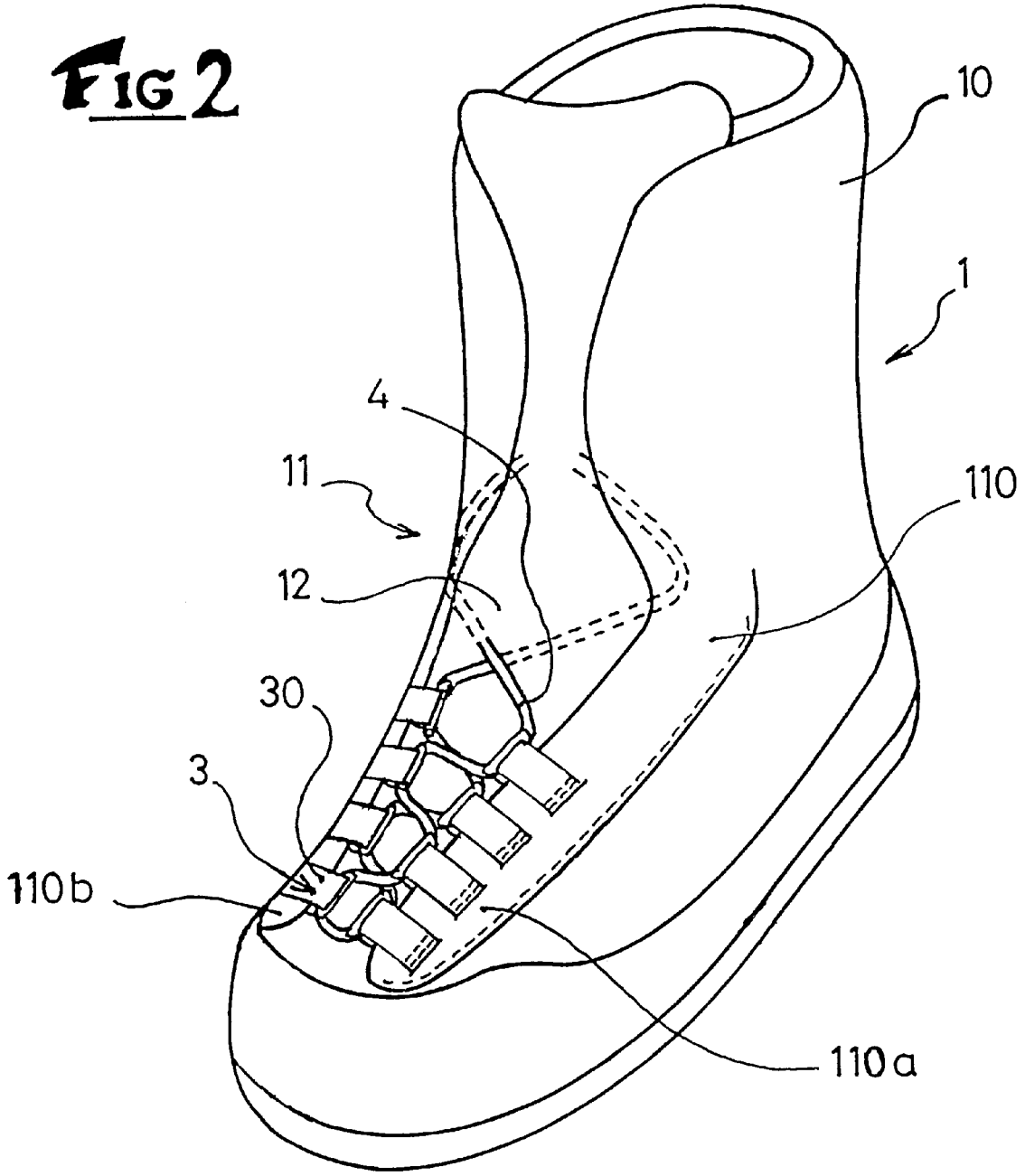
FIG. 2 is a simplified perspective view of a boot according to the invention.

As is shown in FIG. 2, this solution comprises using return elements 3 comprising a closed loop 30 made of a traction-resistant and flexible material.

The boot of FIG. 2 is deliberately simplified in order to show the highlights of the invention. The upper has a portion 110, the frontal or vamp portion in this case, which is equipped with an opening 12 that demarcates the two quarters 110*a* and 110*b* that are to be tightened.

The return elements are distributed across from each other on either side of the opening 12 along each quarter 110*a* and 110*b*.

A tightening device such as a lace 4 is provided in order to extend through each loop 30 along a criss-crossing path, and alternates a return element and its complementary element, for example. This causes the two quarters to come closer together.

Such a lacing method is not the only embodiment that is possible.

Figure 3:
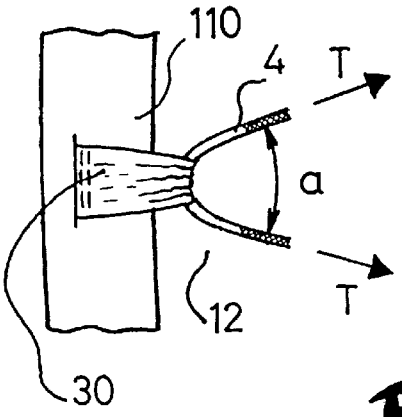
FIG. 3 is a detailed view of a prior art boot.

FIG. 3, which is an illustration of prior art, shows the major defect caused by the return element. The loop 30, here present in the form of a portion of the strap attached to an upper portion 110, is subject to substantial traction from the tightening device or lace 4. Since the return angle "a" is relatively small when the loops are brought closer together, there is deformation of the strap due to a reduction of its width, and thus substantial friction is caused, which resists the sliding of the lace in the loop. Such a phenomenon can have an adverse effect on the homogeneity or uniformity of the tightening process, especially at the end, when the ends of the lace are pulled. This would mean that one has to restart the tightening operation by once again pulling on each end of the lace comprised between two loops. The lacing operation can therefore become time-consuming and bothersome.

This friction can also cause the premature wear and tear of the strap of the loop, and may even cause it to break.

Figure 4:
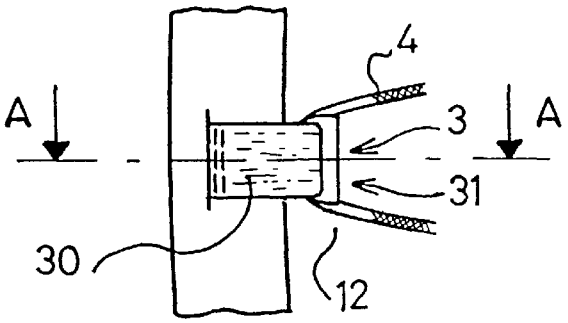
FIG. 4 is a view similar to the one shown in FIG. 3, wherein the solution according to the invention has been put into application.

FIG. 4 represents the solution set forth by the invention. The return element 3, as represented, comprises a closed loop identical to the one in FIG. 3, but which is associated to a guiding portion 31.

Figure 5:
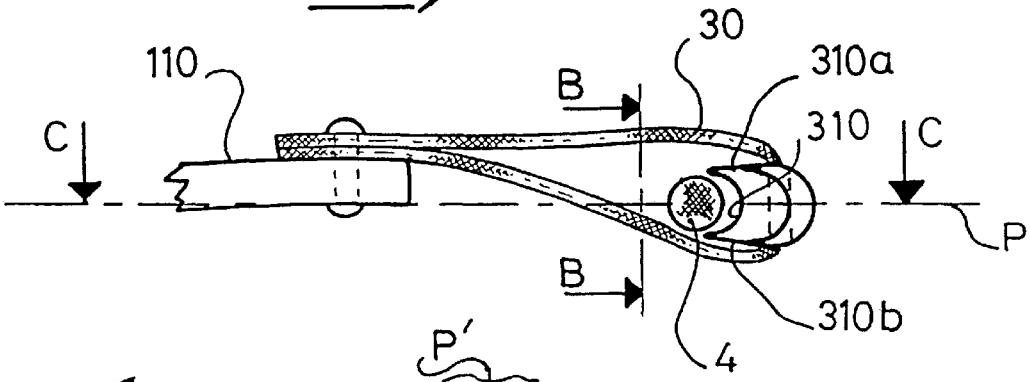
FIG. 5 is a sectional view taken along line A—A of FIG. 4.

As has been shown in FIG. 5, the guiding portion of the return element 31 has a sliding surface 310 for the passage of a tightening device 4 within the flexible loop 30 along a passage plane P. The purpose of this surface is to ease the passage and the sliding of the tightening device 4. As can be seen in FIG. 5, the sliding surface 310 extends only partially around the transversely extending periphery of the tightening device 4. Plane P has been taken as the reference in order to facilitate explanations, and it corresponds approximately to the plane of the path of the lace 4 in the vicinity of each return element. The plane P can vary from one area to another of the boot due to the incurved shape of the upper. As can be seen in FIG. 5, the flexible loop in the illustrated embodiment is in the form of a strap having opposite ends layered upon each other and affixed to the upper portion 110.

Another important characteristic of the guiding portion of the return element is that it has a certain amount of stiffness in plane P as defined. This stiffness should be such that when the tightening device is placed under tension, it does not cause the lateral deformation of the guiding portion, and consequently does not affect the width of the strap of the loop. As such, the width of the guiding portion must be at least equal to the width of the loop.

Figure 6:
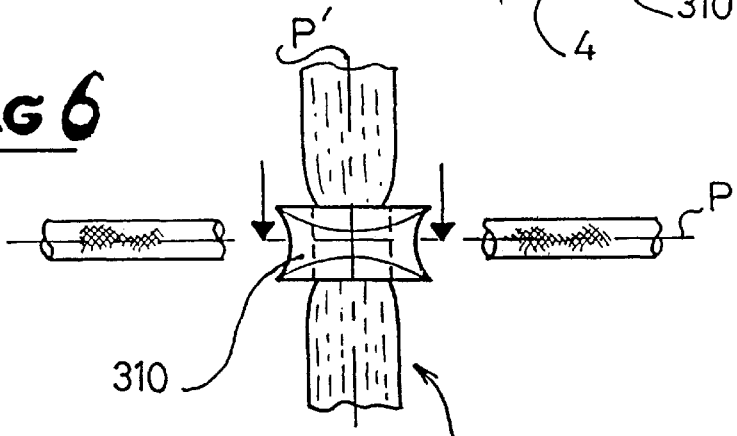
FIG. 6 is a sectional view taken along line B—B of FIG. 5.
Figure 7:
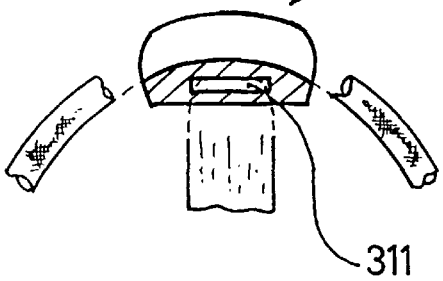
FIG. 7 is a sectional view taken along line C—C of FIG. 5.

FIGS. 6 and 7 represent the unique shape of the sliding surface intended to guide the tightening device 4 when it slides. The sliding surface of the guiding portion has a generatrix having a convex shape in the passage plane P and a generatrix having a concave shape in the plane P' that is perpendicular to P. The concavity in the plane P' favors the retention and guidance of the lace in contact with the element. As regards the sliding, it is improved by the convexity along plane P.

The neck shape thus defined in general terms is however not the only one possible. One could also ensure that the surface has a tubular shape in order to guarantee the guiding of the lace in all radial directions.

Preferably, the thicknesses of the lateral edges 310*a*, 310*b* of the guiding portion of the return element are provided in accordance with the material used, so that they demonstrate a certain ability to deform under compression in the direction along plane P'. Due to this fact, the hard spot phenomenon mentioned previously disappears completely.

According to another characteristic of the invention, the portion element has a slot 311 which ensures the passage of a portion of strap 30 through the guiding portion and its connection with the guiding portion. This slot crosses the element from one edge 310*a* to the other 310*b*. The advantage of this connecting arrangement is that it is the most resistant and the simplest to implement. However, other connecting arrangements can also be envisioned, such as via riveting, clipping/pinching, hooking, etc.

As has been shown in the various drawings, the return elements 3 are distributed across from each other on each quarter 110*a* and 110*b* and are arranged in such a way that each loop has one part that is connected onto one of the quarters, and one part that includes the guiding portion which spills over from the quarter along opening 12.

In this way, the guiding portion is positioned in the thickness of the quarter when pressure is exerted on the tightening device by an external element; and this is partially due to the flexibility of the loop. The risks of hard spots are reduced in this manner.

Preferably, the strap portion is selected from a textile material due to its properties of flexibility and traction resistance. In some cases, one could also possibly think of using strip portions made of rubber or leather. The strap portion is preferably connected to the upper by stitching, or other means can also be envisioned, such as riveting, hooking, or a combination of various means. An embodiment wherein a strap portion is provided as a continuous part of a piece of fabric of the upper also falls within the scope of the invention.

The guiding portion of the return element is constituted by a material having a low friction coefficient. Several materials can be considered suitable. Preferably, the guiding portion is constituted of a plastic Material selected from among PTFEs, PTFCEs, FEPs, nylons, polyamides, polyethylenes, and polyacetals.

The guiding portion of the return element can be made all in one piece, or conversely, it can be made of various parts that are mechanically assembled or molded.

The instant invention is not limited to the embodiments described hereinabove and it includes all equivalents thereof which could fall within the scope of the following claims.

The instant application is based upon the French priority patent application No. 96 10700 filed on Aug. 29, 1996, the disclosure of which is hereby expressly incorporated by reference thereto, and the priority of which is hereby claimed under 35 USC 119.

What is claimed is:

1. A sports boot comprising:

an upper and a series of return elements affixed to a portion of the upper;

a tightening device cooperating with the return elements to tighten said portion of the upper;

each of a plurality of said series of return elements comprising a closed loop made of a flexible and traction-resistant material, the closed loops being affixed to said portion of the upper;

each of the plurality of said series of return elements further having a respective guiding portion connected to the closed loop, each of said guiding portions having a respective sliding surface upon which the tightening device is guided along a passage plane, and each of said guiding portions of the return elements being made of a material having a predeterminate stiffness in said passage plane to resist deformation when the tightening device is tensioned to tighten said portion of the upper;

said sliding surface extending around less than an entirety of a transversely extending periphery of the tightening device.

2. A sports boot according to claim 1, wherein:

said tightening device comprises a lace.

3. A sports boot according to claim 1, wherein:

each of said guiding portions of said return elements is positioned laterally inside of respective guided portions of said tightening device.

4. A sports boot according to claim 1, wherein:

each of said guiding portions of said return elements extends within a respective one of said flexible closed loops.

5. A sports boot according to claim 1, wherein:

said sliding surface extends around no more than substantially one half of a transversely extending periphery of the tightening device.

6. A sports boot according to claim 1, wherein:

each of said guiding portions of said return elements is made of a plastic material.

7. A sports boot according to claim 1, wherein:

each of said guiding portions of said return elements is made of a plastic material comprising a member selected from the group consisting of PTFEs, PTFCEs, FEPs, nylons, polyamides, polyethylenes, and polyacetals.

8. A sports boot according to claim 1, wherein:

said closed loop of each of said return elements comprises a strap extending through a respective one of said guiding portions.

9. A sports boot according to claim 1, wherein:

said closed loop of each of said return elements comprises a strap having opposite ends layered upon each other and affixed to said portion of the upper.

10. A sports boot according to claim 9, wherein:

said strap is made of a textile material.

11. A sports boot according to claim 1, wherein:

said portion of the upper has an opening defined by two quarters to be tightened, the series of return elements being distributed across from each other;

each of said loops has a portion affixed to one of said two quarters and a portion, to which one of said guiding portions is attached, extending within said opening.

12. A sports boot according to claim 1, wherein:

said sliding surface of each of the return elements has a convex surface in a passage plane and a concave surface in a plane that is perpendicular to said passage plane.

13. A sports boot comprising:

an upper and a series of return elements affixed to the upper;

a tightening device cooperating with the return elements to tighten a portion of the upper;

each of a plurality of said series of return elements comprising a closed loop made of a flexible and traction-resistant material, the closed loops being affixed to the upper;

each of the plurality of said series of return elements further having a respective guiding portion connected to the closed loop, each of said guiding portions having a respective sliding surface upon which the tightening device is guided along a passage plane;

each of said guiding portions of the return elements comprising means for resisting lateral deformation when the tightening device is tensioned to tighten said portion of the upper, said means comprising a sliding surface extending around less than an entirety of a transversely extending periphery of the tightening device.

14. A return element in combination with a lacing for tightening a portion of an upper of a sports boot, said return element comprising:

a closed loop made of a flexible and traction-resistant material, the closed loop being adapted to be affixed to the upper of the sports boot;

a guiding portion connected to the closed loop, each of said guiding portions having a respective sliding surface upon which the tightening device is adapted to be guided along a passage plane, and each of said guiding portions of the return elements being made of a material having a predeterminate stiffness in said passage plane to resist deformation when the tightening device is tensioned to tighten the portion of the upper;

said sliding surface extending around less than an entirety of a transversely extending periphery of the lacing.

15. A return element according to claim 14, wherein:

said flexible and traction-resistint material comprising a textile material.

16. A return element according to claim 14, wherein:

said closed loop comprises a strap extending through a respective one of said guiding portions.

17. A return element according to claim 14, wherein:

said sliding surface has a convex surface in a passage plane and a concave surface in a plane that is perpendicular to said passage plane.

18. A return element according to claim 14, wherein:

said guiding portion extends within a respective one of said flexible closed loops.

19. A return element according to claim 14, wherein:

said guiding surface has a shape that extends around less than an entirety of a transversely extending periphery of the tightening device.

20. A return element according to claim 14, wherein:

said sliding surface extends around no more than substantially one half of a transversely extending periphery of the tightening device.

* * * * *